US006790124B2

(12) United States Patent
Shibata

(10) Patent No.: US 6,790,124 B2
(45) Date of Patent: Sep. 14, 2004

(54) EYEGLASS LENS PROCESSING APPARATUS

(75) Inventor: Ryoji Shibata, Toyokawa (JP)

(73) Assignee: Nidek Co., Ltd., Aichi (JP)

( * ) Notice: Subject to any disclaimer, the term of this patent is extended or adjusted under 35 U.S.C. 154(b) by 44 days.

(21) Appl. No.: 10/290,332

(22) Filed: Nov. 8, 2002

(65) Prior Publication Data

US 2003/0087584 A1 May 8, 2003

(30) Foreign Application Priority Data

Nov. 8, 2001 (JP) ..... P2001-343726

(51) Int. Cl.[7] ..... B24B 1/00

(52) U.S. Cl. ..... 451/5; 451/42; 451/255; 51/165.71

(58) Field of Search ..... 457/5, 8, 9, 15, 457/10, 11, 41, 42, 69, 70, 178, 180, 211, 247, 240, 255, 256, 332, 44, 362, 390, 398; 364/474.01; 51/165.71, 101

(56) References Cited

U.S. PATENT DOCUMENTS

| | | | | |
|---|---|---|---|---|
| 2,908,348 | A | * 10/1959 | Rivers et al. | 96/67 |
| 5,217,335 | A | * 6/1993 | Houchens et al. | 409/80 |
| 5,321,915 | A | * 6/1994 | Lecerf et al. | 451/6 |
| 5,716,256 | A | 2/1998 | Mizuno et al. | |
| 5,727,987 | A | * 3/1998 | Gottschlad | 451/5 |
| RE35,898 | E | 9/1998 | Shibata et al. | |
| 5,882,247 | A | 3/1999 | Longuet et al. | |
| 6,168,505 | B1 | * 1/2001 | Gottschald | 451/43 |
| 6,328,628 | B1 | * 12/2001 | Mizuno et al. | 451/5 |
| 6,427,094 | B1 | * 7/2002 | Mizuno | 700/159 |
| 6,478,657 | B1 | * 11/2002 | Shibata | 451/5 |
| 6,478,658 | B1 | * 11/2002 | Logan | 451/5 |
| 6,497,482 | B1 | * 12/2002 | Matsuyama | 351/41 |
| 6,497,614 | B2 | * 12/2002 | Kobayashi et al. | 451/43 |
| 6,530,156 | B1 | * 3/2003 | Matsuyama | 33/507 |
| 6,564,111 | B1 | * 5/2003 | Gottschald | 700/95 |

FOREIGN PATENT DOCUMENTS

| | | |
|---|---|---|
| DE | 197 38 668 | 3/1999 |
| DE | 198 04 428 | 8/1999 |
| EP | 1 066 918 A2 | 1/2001 |
| JP | 3-277458 | 12/1991 |
| JP | 5-212661 | 8/1993 |
| JP | 9-253999 | 9/1997 |
| JP | 9-290399 | 11/1997 |

* cited by examiner

*Primary Examiner*—Joseph J. Hail, III
*Assistant Examiner*—Anthony Ojini
(74) *Attorney, Agent, or Firm*—Sughrue Mion, PLLC

(57) ABSTRACT

An eyeglass lens processing apparatus for processing a periphery of an eyeglass lens, includes: a lens rotation shaft which holds and rotates the lens, the shaft being rotatable about a first axis; a piercing tool which pierces a hole in the lens; a holder which rotatably holds the piercing tool; and inclination means for relatively inclining the holder with respect to the lens rotation shaft to change inclination of a rotation axis of the piercing tool with respect to the first axis.

13 Claims, 13 Drawing Sheets

EYEGLASS LENS PROCESSING APPARATUS

BACKGROUND OF THE INVENTION

The present invention relates to an eyeglass lens processing apparatus for processing a periphery of an eyeglass lens.

An eyeglass lens processing apparatus is known, which processes a periphery of an eyeglass lens using a grinding tool (such as a grinding stone and a machining cutter) so that the eyeglass lens is formed into a target lens shape (an eyeglass frame configuration or the like). In a case of a so-called two point frame (rimless glasses), a piercing is performed on the lens having been processed on the periphery. Conventionally, the piercing was manually practiced by an expert by use of a drilling machine. In this case, a hole direction is usually a normal direction at a hole position in a lens front surface.

Further, there is also proposed an eyeglass lens processing apparatus equipped with a piercing mechanism, which sets a hole direction in a direction perpendicular with respect to a lens rotation axis.

However, it is not easy to manually pierce the lens using the drilling machine or the like, and therefore a good piercing is difficult to an inexperienced operator.

In case of the existing eyeglass lens processing apparatus equipped with the piercing mechanism, the piercing is done to a lens edge surface, and therefore an applicable two point frame is limited.

An experienced expert sometimes adjusts a hole direction, taking a counteraction of the lens at forming a frame into consideration. This tendency is remarkable particularly in a case of a half-eye lens. This is because the hole direction gives large influences to finishing of the frame. However, since the conventional lens processing apparatus cannot change the hole direction, the frame cannot be finished into a desired configuration.

SUMMARY OF THE INVENTION

In view of the above mentioned conventional technique, an object of the present invention is to provide an eyeglass lens processing apparatus, which can easily carry out a favorably piercing, and which has a great freedom in setting a hole direction.

To achieve the object, the invention is characterized by providing the following structures.

(1) An eyeglass lens processing apparatus for processing a periphery of an eyeglass lens, comprising:

a lens rotation shaft which holds and rotates the lens, the shaft being rotatable about a first axis;

a piercing tool which pierces a hole in the lens;

a holder which rotatably holds the piercing tool; and inclination means for relatively inclining the holder with respect to the lens rotation shaft to change inclination of a rotation axis of the piercing tool with respect to the first axis.

(2) The apparatus of (1), further comprising:

control means for controlling rotation of the lens rotation shaft and inclination by the inclination means, based on piercing data including hole direction data.

(3) The apparatus of (2), further comprising:

first moving means for relatively moving the lens rotation shaft linearly in a direction of the first axis with respect to the piercing tool; and second moving means for relatively moving the lens rotation shaft linearly in a direction of a second axis perpendicular to the first axis or swingably to direct the first axis to the same direction, with respect to the piercing tool;

wherein the control means controls movement by each of the first and second moving means, based on the piercing data including hole position data.

(4) The apparatus of (3), wherein the inclination means includes rotation means for rotating the holder about a third axis perpendicular to the first axis, the rotation axis of the piercing tool being perpendicular to the third axis.

(5) The apparatus of (3), further comprising:

third moving means for moving the piercing tool between a piercing position and a retreat position, wherein the control means controls movement by the third moving means, based on the piercing data.

(6) The apparatus of (5), wherein the third moving means moves the piercing tool linearly in a direction of the third axis.

(7) The apparatus of (5), further comprising:

protection means for protecting the piercing tool moved to the retreat position.

(8) The apparatus of (3), further comprising:

a grinding tool rotation shaft which holds and rotates a grinding tool for grinding the periphery of the lens, the grinding tool rotation shaft being rotatable about a fourth axis parallel to the first axis, wherein the first moving means relatively moves the lens rotation shaft linearly with respect to the grinding tool, wherein the second moving means relatively moves the lens rotation shaft linearly or swingably with respect to the grinding tool, wherein the control means control rotation of the lens rotation shaft and movement by the second moving means, based on periphery grinding data.

(9) The apparatus of (2), further comprising:

lens configuration measurement means for measuring a front surface configuration of the lens; and calculation means for obtaining a normal direction at a hole position in the lens front surface, based on the obtained configuration, wherein the hole direction data includes data on the obtained normal direction.

(10) The apparatus of (1), wherein the holder holds at least one of a grooving grinding stone for forming a groove in an edge surface of the lens and a chamfering grinding stone for chamfering an edge corner of the lens to be rotatable coaxially with respect to the piercing tool.

(11) The apparatus of (1), wherein the inclination means includes rotation means for rotating the holder about an axis perpendicular to the rotation axis of the piercing tool.

(12) The apparatus of (1), further comprising:

moving means for moving the piercing tool between a piercing position and a retreat position.

(13) An eyeglass lens processing apparatus for processing a periphery of an eyeglass lens, comprising:

a lens rotation shaft which holds and rotates the lens, the shaft being rotatable about a first axis;

a piercing tool which pierces a hole in the lens; and a holder which rotatably holds the piercing tool, wherein the holder holds at least one of a grooving grinding stone for forming a groove in an edge surface of the lens and a chamfering grinding stone for chamfering an edge corner of the lens to be rotatable coaxially with respect to the piercing tool.

The present disclosure relates to the subject matter contained in Japanese patent application No. P2001-343726 (filed on Nov. 18, 2001), which is expressly incorporated herein by reference in its entirety.

DESCRIPTION OF THE PREFERRED EMBODIMENT

Reference will be made to an embodiment of the invention with the attached drawings.

(1) Overall Structure

Figure 1:
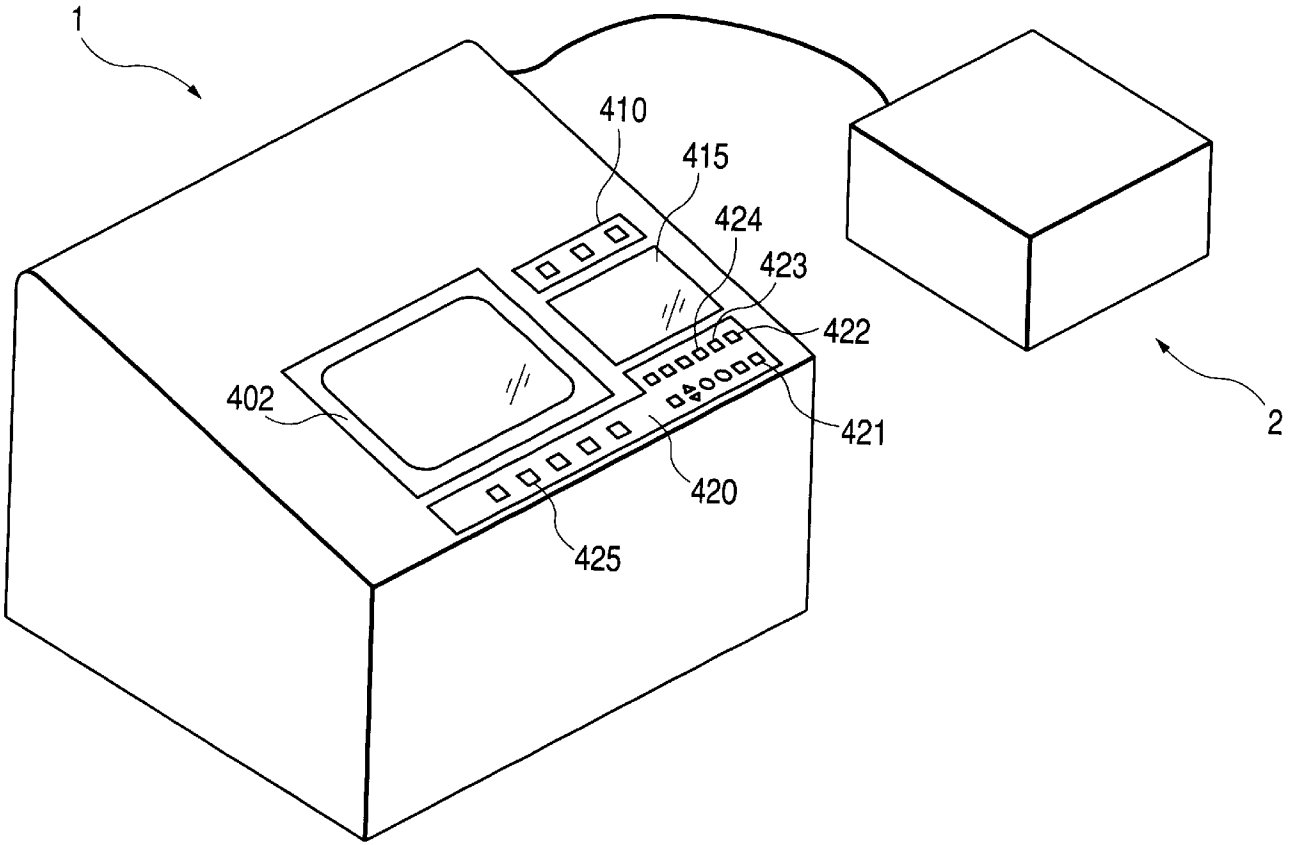
FIG. 1 is a schematic view showing an exterior structure of an eyeglass lens processing apparatus according to the present invention.

FIG. 1 is a schematic view showing an exterior structure of an eyeglass lens processing apparatus according to the invention. Numeral 1 designates a main body of the eyeglass lens processing apparatus, to which an eyeglass frame configuration measurement device 2 is connected. The eyeglass frame configuration measurement device 2 used in this apparatus is described, for example, in Patent Laid Open 5-212661 and Re. 35,898 (U.S. Pat. No. 5,347,762) assigned to the present assignee. The main body 1 has, in an upper part thereof, a display 415 for displaying processing data, etc., a switch panel 410 having various switches for inputting processing conditions, etc., and a switch panel 420 having various switches for instructions for processing. Numeral 402 designates an openable window for a processing chamber.

Figure 2:
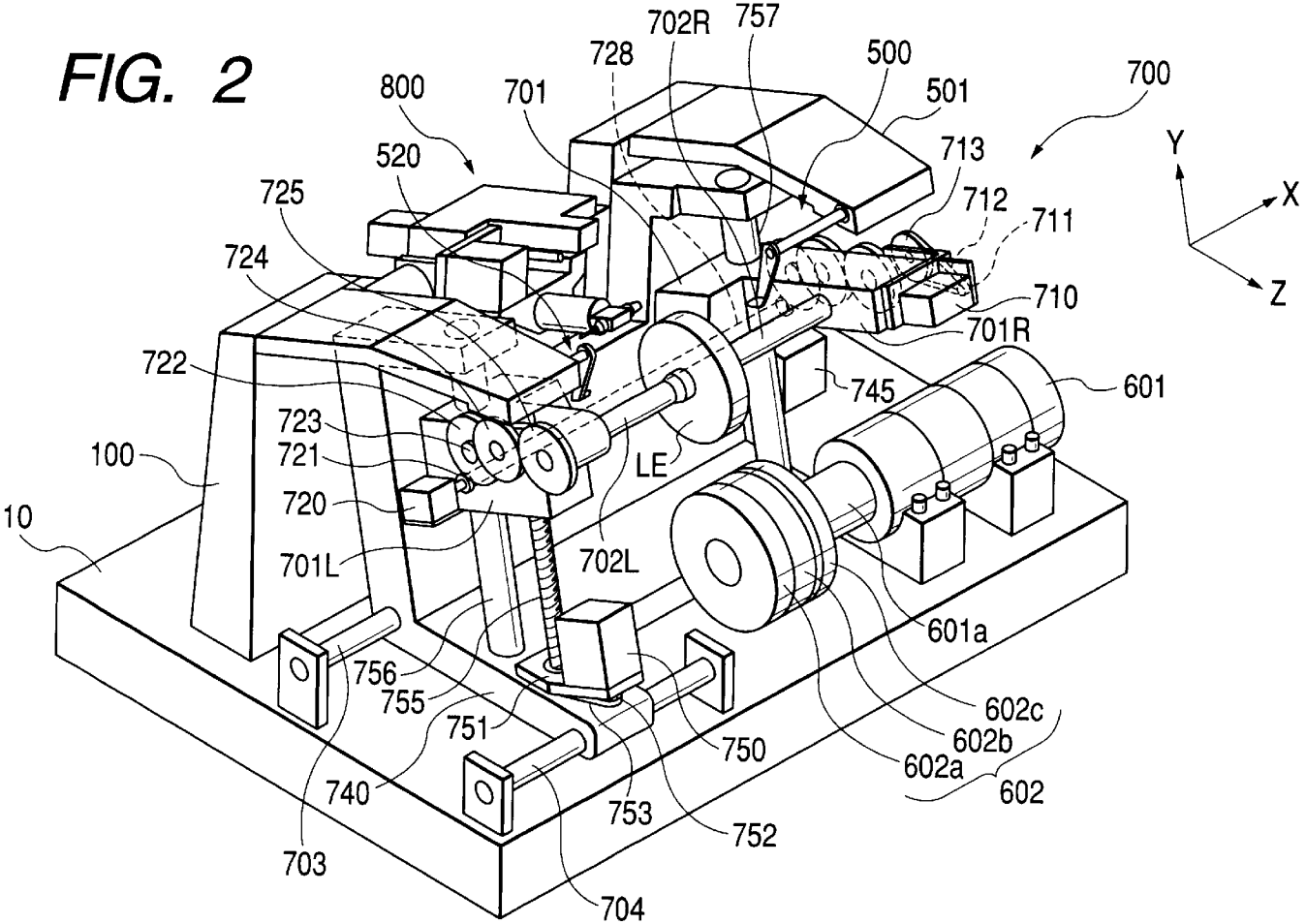
FIG. 2 is a perspective view showing the schematic structure of a lens processing part disposed within a casing of a main body of the apparatus.

FIG. 2 is a perspective view showing the schematic structure of a lens processing part to be installed within a casing of the main body 1. A carriage part 700 is mounted on a base 10, and a lens LE to be processed is held between lens rotation shafts (lens chuck shafts 702L and 702R) of a carriage 701, and subjected to a grinding process by being pressure-contacted with grinding stone group 602 attached to a grinding stone-rotation shaft 601*a*. The shafts 702L and 702R and the shaft 601*a* are arranged so that their rotation axes are in parallel to each other. Numeral 601 designates a grinding stone-rotation motor. The grinding stone group 602 comprises a rough grinding stone 602*a* for glasses, a rough grinding stone 602*b* for plastic and a finish grinding stone 602*c* for beveling and flat processing. Above the carriage 701, lens configuration measurement parts 500 and 520 are disposed. At a rear side of the carriage part 700, a piercing-chamfering-grooving mechanism part 800 is disposed.

(2) Structure of Each of Parts (A) Carriage Part

The structure of the carriage part 700 will be explained on the basis of FIG. 2. The shafts 702L and 702R can clamp the lens LE therebetween to rotate the lens LE. The carriage 701 is movable along carriage shafts 703 and 704 that are secured to the base 10 and that extend in parallel to the shaft 601*a*.

The carriage 701 is also movable to change an axis-to-axis distance between a rotation axis of the shafts 702L and 702R and a rotation axis of the shaft 601*a*. In the following description, it is assumed that a direction in which the carriage 701 is linearly moved in parallel to the shaft 601*a* is an X axis direction (a rotation axis direction of the shafts 702L and 702R), while a direction in which the carriage 701 is linearly moved to change the axis-to-axis distance between the shafts 702L and 702R and the shaft 601*a* is an Y axis direction (an axis direction perpendicular to the X axis), and explanation will be made to the lens chuck mechanism, the lens rotation mechanism, and the X axis direction moving mechanism and the Y axis direction moving mechanism of the carriage 701.

<Lens Chuck Mechanism and Lens Rotation Mechanism>

The shaft 702L and the shaft 702R is rotatably held, respectively, on a left arm 701L of the carriage 701 and a right arm 701R thereof to be coaxial with respect to each other. A chucking motor 710 is secured on a front portion of the right arm 701R, and rotation of a pulley 711 mounted on the rotation shaft of the motor 710 is transmitted to a pulley 713 via a belt 712, and the rotation thus transmitted is further transmitted to a feed screw and a feed nut (both not shown) rotatably held within the right arm 701R. This causes the shaft 702R to be moved in the rotation axis direction (the X axis direction), so that the lens LE is clamped by the shafts 702L and 702R.

A lens rotating motor 720 is fixed on a left side end portion of the left arm 710L. A gear 721 mounted on the rotation shaft of the motor 720 is in mesh with a gear 722, a gear 723 coaxial with the gear 722 is in mesh with a gear 724, and the gear 724 is in mesh with a gear 725 attached to the shaft 702L. By this arrangement, the rotation of the motor 720 is transmitted to the shaft 702L.

The rotation of the motor 720 is transmitted to the right arm 701R side via a rotation shaft 728 rotatably supported at the rear of the carriage 701. The right arm 701R is furnished at its right side end portion with similar gears as those of the left side end portion of the left arm 701L (being the same as the gears 721 to 725 at the left side end portion of the left arm 701L, detailed explanation will be omitted). By this arrangement, the shaft 702L and the shaft 702R are rotated in synchronization with each other.

<X Axis Direction Moving Mechanisms and Y Axis Direction Moving Mechanism of Carriage>

A moving support base 740 is attached to the shafts 703 and 704 so as to be movable in the axis direction thereof (in the X axis direction). The support base 740 is provided at its rear with a ball screw (not shown) attached thereto, which extends in parallel to the shaft 703, and this ball screw is attached to the rotation shaft of an X axis moving motor 745 fixed to a base 10. The rotation of the motor 745 is transmitted to the ball screw. By the rotation of the ball screw, the carriage 701 is linearly moved in the X axis direction together with the support base 740.

Shafts 756 and 757 extending in the Y axis direction are fixed to the support base 740. The carriage 701 is attached to the shafts 756 and 757 so as to be movable in the Y axis direction. A Y axis moving motor 750 is fixed to the support base 740 by an attaching plate 751. The rotation of the motor 750 is transmitted to a ball screw 755, rotatably held by the attaching plate 751, via a pulley 752 and a belt 753. By the rotation of the ball screw 755, the carriage 701 is linearly moved in the Y axis direction (to change the axis-to-axis distance between the shafts 702L and 702R and the shaft 601*a*).

(B) Lens Configuration Measurement Part

Figure 3:
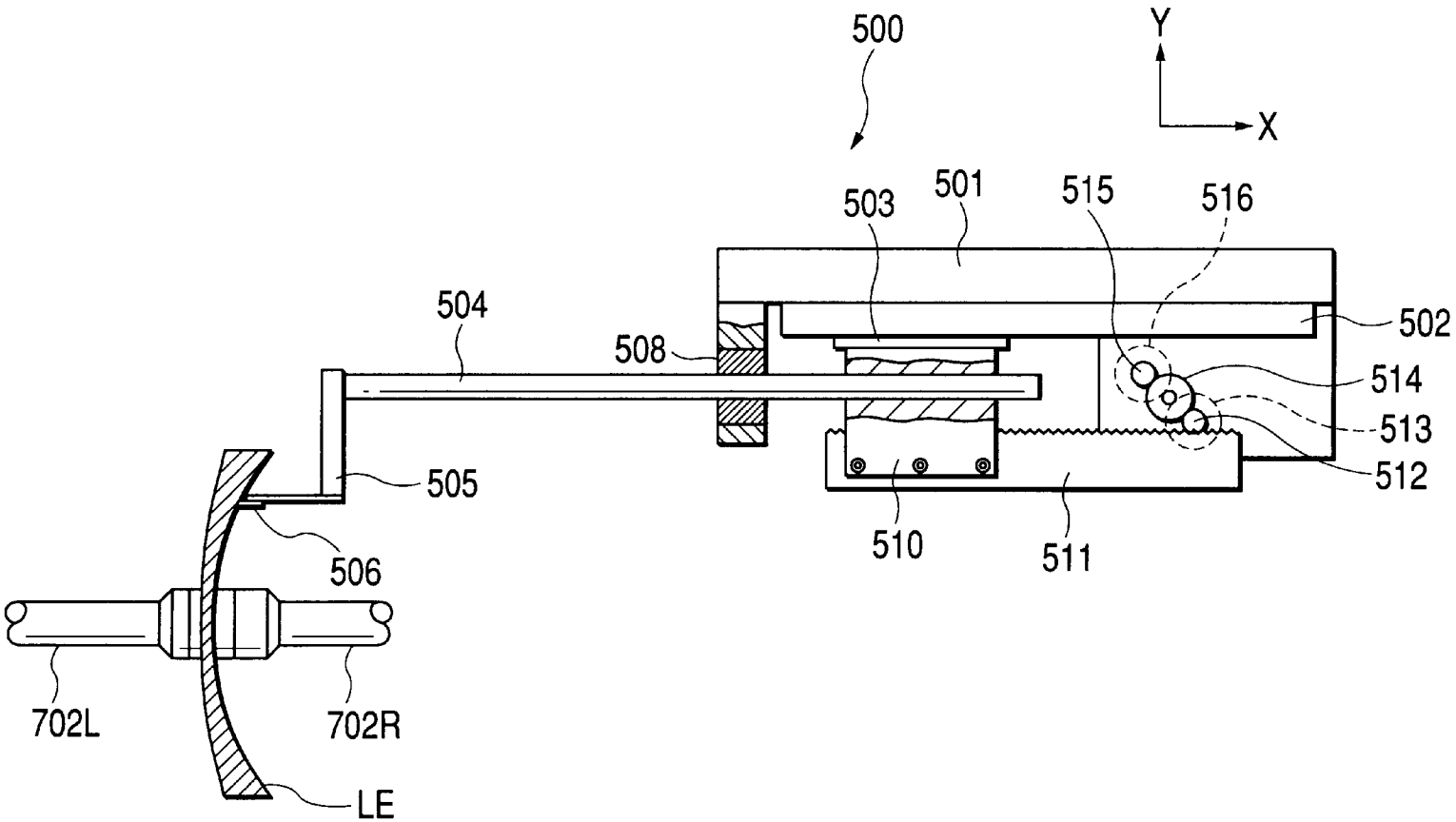
FIG. 3 is a front view showing the schematic structure of a lens configuration measurement part.

FIG. 3 is a view for explaining the schematic structure of a lens configuration measurement part 500 for a lens rear surface (lens rear side refractive surface). A support base 501 is fixed to a support base block 100 fixedly provided on the base 10 (see FIG. 2), and a slider 503 is slidably attached onto a rail 502 fixed to the support base 501. A slide base 510 is fixed to the slider 503, and a feeler arm 504 is fixed to the slide base 510. A ball bush 508 is fitted to the side surface of the support base 501 so as to eliminate rattling of the feeler arm 504. An L-shaped feeler hand 505 is fixed to the leading end portion of the arm 504, and a feeler 506 in the form of a circular plate is attached to the leading end portion of the hand 505. For measuring the lens configuration, the feeler 506 is brought into contact with the rear surface of the lens LE.

A rack 511 is fixed to the lower end portion of the slide base 510. The rack 511 is in mesh with a pinion 512 of an encoder 513 fixed to the support base 501. The rotation of the motor 516 is transmitted to the rack 511 via a gear 515 attached to the rotation shaft of the motor 516, an idle gear 514 and the pinion 512 so that the slide base 510 is moved in the X axis direction. During measurement of the lens configuration, the motor 516 pushes the feeler 506 against the lens LE at constant force. The encoder 513 detects a moving amount of the slide base 510 (i.e. a moving amount of the feeler 506) in the X axis direction. By the information of this moving amount and the rotation angle of the shafts 702L and 702R, the rear surface configuration of the lens LE is measured.

As a lens configuration measurement part 520 for a lens front surface (a lens front side refractive surface) is symmetrical with respect to the lens configuration measurement part 500, explanation for the structure is omitted.

(C) Piercing-Chamfering-Grooving Mechanism Part

Figure 4:
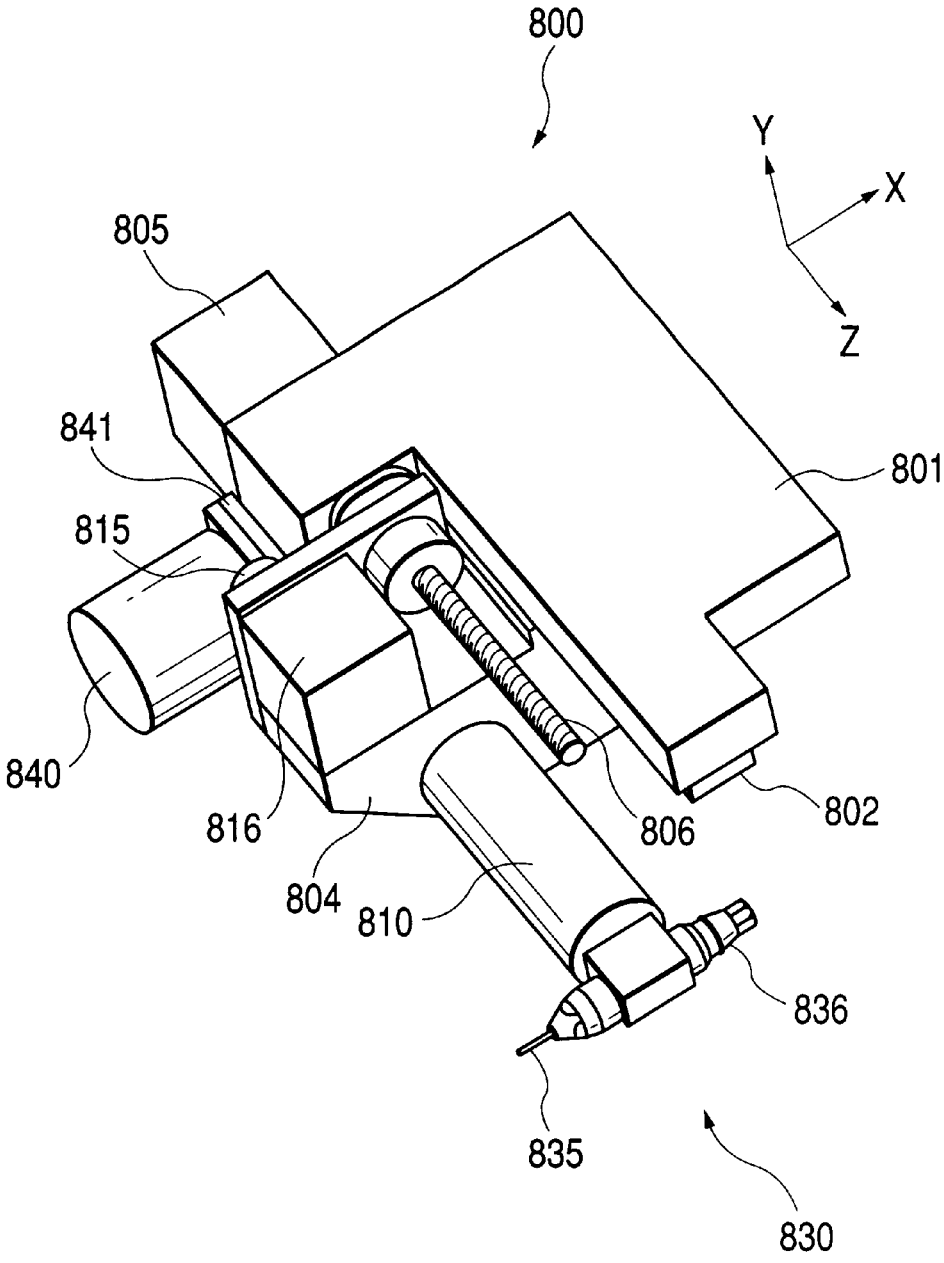
FIG. 4 is a perspective view showing the schematic structure of a piercing-chamfering-grooving mechanism part.
Figure 5B:
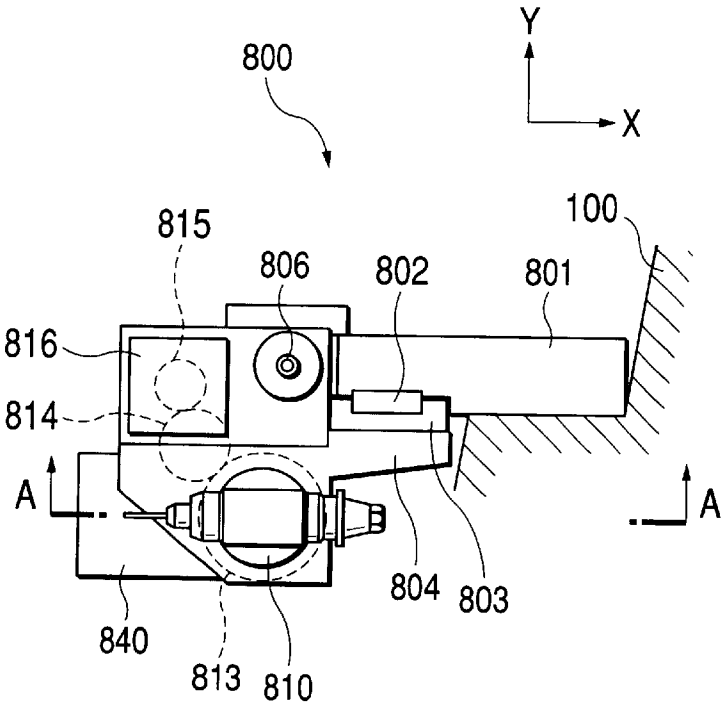
FIGS. 5A and 5B are a front view and a left side view showing the schematic structure of the piercing-chamfering-grooving mechanism part.
Figure 5A:
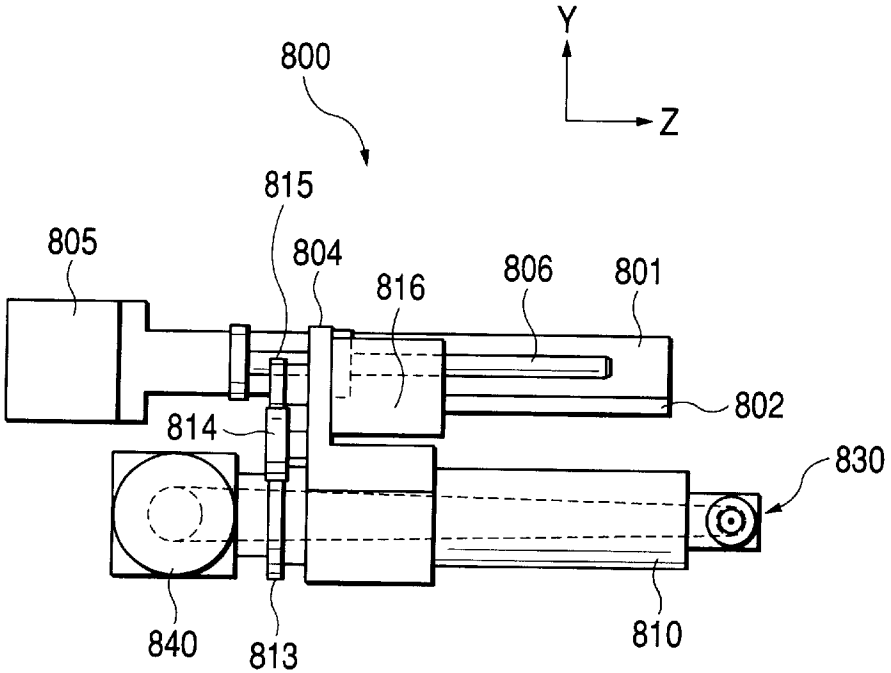
Figure 6:
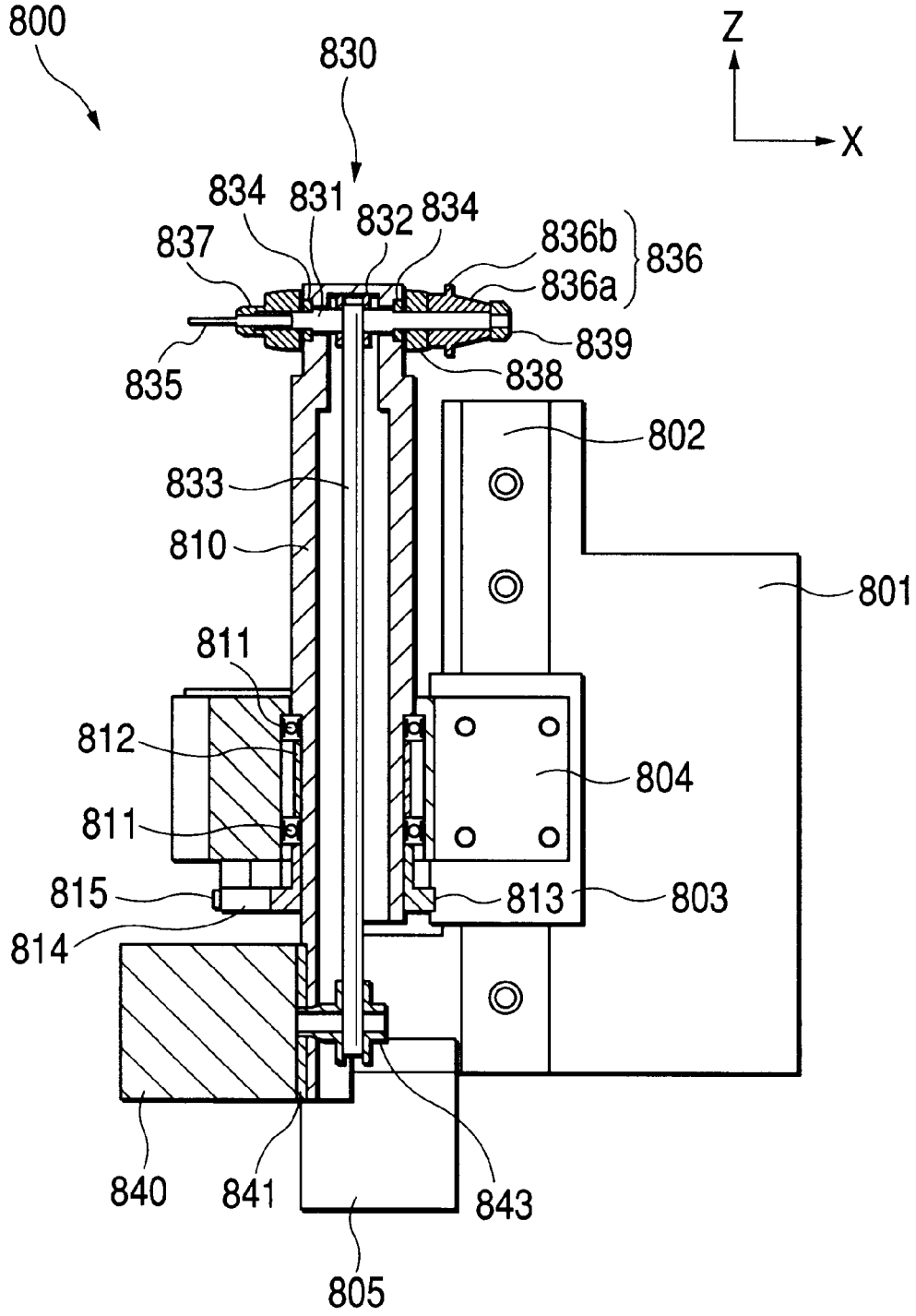
FIG. 6 is a cross sectional view showing the schematic structure of the piercing-chamfering-grooving mechanism part.

Explanation will be made to a schematic structure of the piercing-chamfering-grooving mechanism part 800 on the basis of FIGS. 4 to 6. FIG. 4 is a three-dimensional view of the mechanism part 800, FIG. 5A is a left side view, FIG. 5B is a front view, and FIG. 6 is an A—A cross sectional view of FIG. 5B.

A fixing plate 801 serving as a base of the mechanism part 800 is fixed to the block 100. A rail 802 extending in a Z axis direction (which is an axis direction perpendicular to at least the X axis, and in this embodiment, an axis direction perpendicular with respect to an X-Y axes plane) is fixed to the fixing plate 801, and a slider 803 is slidably mounted on the rail 802. A moving support base 804 is fixed to the slider 803. The support base 804 is linearly moved in the Z axis direction by a motor 805 rotating a ball screw 806.

A rotating support base 810 is rotatably supported by bearings 811 onto the support base 804. The two bearings 811 are used, and a spacer 812 is disposed to keep a distance therebetween. At one side of the bearing 811, a gear 813 is fixed to the support base 810. The gear 813 is in mesh with an idle gear 614, which is, in turn, in mesh with a gear 815 fixed to the rotation shaft of the motor 816 fixed to the support base 804 via an idle gear 814. By this arrangement, the support base 810 is rotated about an axis of the bearings 811 when the motor 816 is rotated.

A rotation part 830 holding a piercing drill 835 and a grinding stone portion 836 is attached to the leading end portion of the support base 810. A pulley 832 is attached to a center portion of a rotation shaft 831 of the rotation part 830, and the shaft 831 is rotatably supported by two bearings 834. The drill 835 is attached to one end of the shaft 831 by a chuck mechanism 837, and a spacer 838 and the grinding stone portion 836 is attached to the other end of the shaft 831 by a nut 839. The grinding stone portion 836 is constructed by a chamfering grinding stone 836*a* and a grooving grinding stone 836*b* formed integrally with each other. The diameter of the grooving grinding stone 836*b* is about 15 mm, and the chamfering grinding stone 836*a* has an oblique processing surface in conical shape reducing in diameter from the grooving grinding stone 836*a* toward the leading end side. The chamfering grinding stone 836*a* may be cylindrical.

A motor 840 for rotating the shaft 831 is fixed to an attaching plate 841 attached to the support base 810. A pulley 843 is attached to the rotation shaft of the motor 840. A belt 833 is suspended between the pulley 832 and the pulley 843 within the support base 810, for transmitting the rotation of the motor 840 to the shaft 831.

Figure 7:
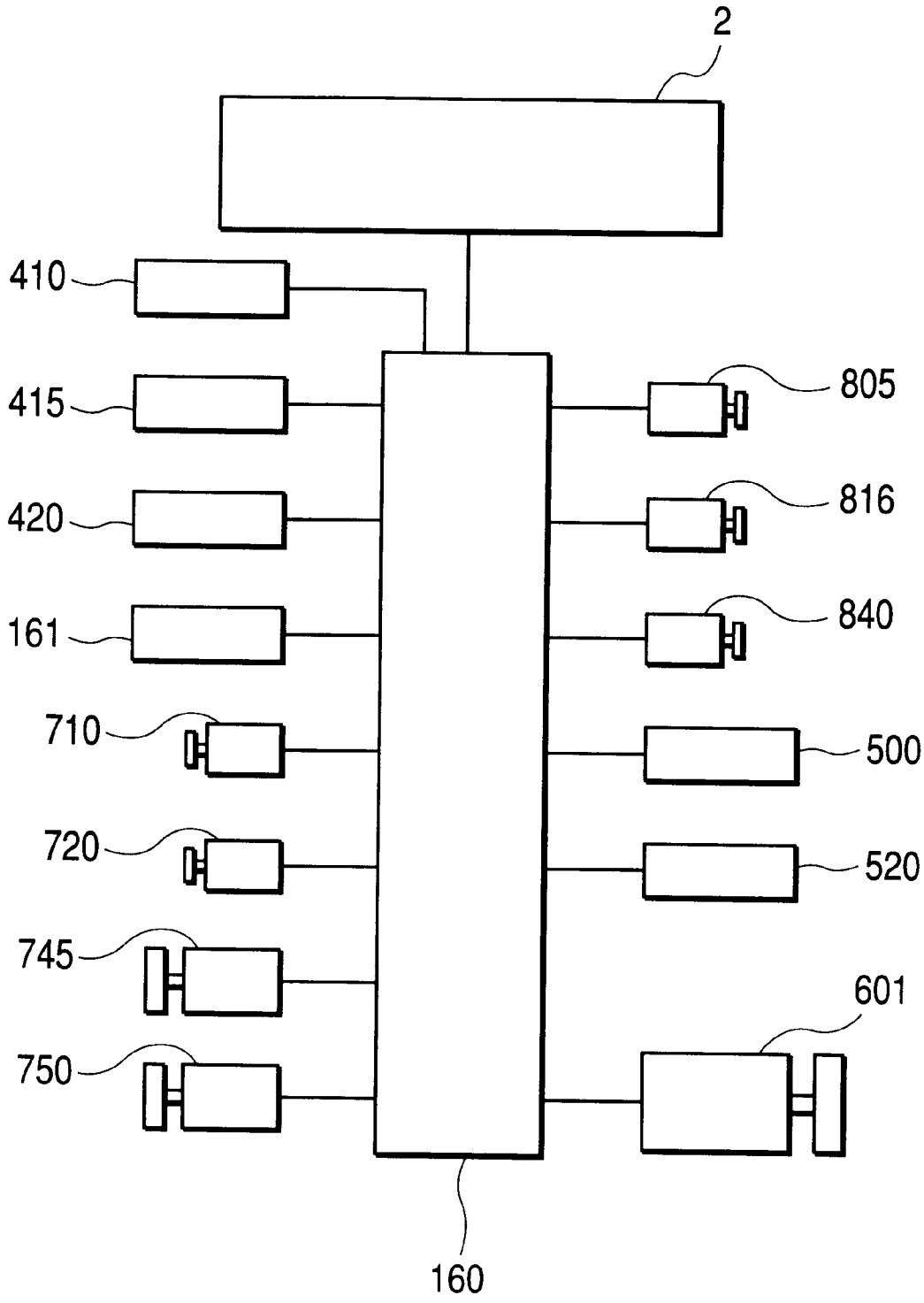
FIG. 7 is a block diagram of a control system of the present apparatus.

Next, the operation of the apparatus having the above mentioned structure will be explained by use of a control system block diagram of FIG. 7. Here, the piercing and the grooving will be mainly discussed.

First of all, a target lens shape (an eyeglass frame configuration) is measured by the eyeglass frame measurement device 2. In a case of the rimless frame, the target lens shape is obtained from a template or a dummy lens. The obtained target lens shape data are input into a data memory 161 by pushing a switch 421. The display 415 displays a figure based on the target lens shape, and the apparatus is ready for inputting the processing conditions, etc. An operator operates the respective switches on the switch panel 410 to input necessary layout data such as a PD of a wearer or a height of an optical center, and to input material of the lens LE to be processed and a processing mode. In case that the piercing is to be executed, a piercing mode is selected by a switch 422. In case that the grooving is to be executed, a grooving mode is selected by a switch 423. In case that the chamfering is to be executed, a switch 424 is operated to select a chamfering mode.

When a necessary input is complete, the lens LE is clamped by and between the shafts 702L and 702R, and thereafter a start switch 425 is pushed to operate the apparatus. A main control part 160 obtains a radius vector data about a processing center on the basis of the input target lens shape data and layout data, thereafter obtains processing data (periphery grinding data) from positional data of a contact point where each radius vector contacts the grinding stone, and stores those data in a memory 161.

Subsequently, in accordance with a process sequence program, the main control part 160 measures the lens configuration using the lens configuration measurement parts 500 and 520. The main control part 160 drives the motor 516 to move the feeler arm 504 in the X axis direction from a retreat position to a measuring position. The main control part 160 moves the carriage 701 in the Y axis direction by driving the motor 750 on the basis of the radius vector data. The main control part 160 drives the motor 516 to move the arm 504 (to push the arm 504 at a slight force) in the X axis direction so that the feeler 506 constantly contacts the rear surface of the lens LE.

Under the condition where the feeler 506 contacts the rear surface of the lens LE, the main control part 160 drives the motor 720 to rotate the shafts 702L and 702R (the lens LE). Concurrently, the main control part 160 drives the motor 750 on the basis of the radius vector data so as to move the carriage 701 in the Y axis direction (vertically). The feeler 506 is moved in the X axis direction (laterally) along the rear surface configuration of the lens LE in conjunction with the rotation of the lens LE and the movement of the carriage 701. The moving amount is detected by the encoder 513, so that the rear surface configuration of the lens LE is measured. After the measurement of the lens rear surface configuration is complete, the main control part 160 drives the motor 516 to move the arm 504 in the X axis direction and position the arm 504 at the retreat position.

Similarly, the front surface configuration of the lens LE is measured by the lens configuration measurement part 520. When the front and rear surface configurations of the lens LE are obtained, lens edge thickness data can be obtained from both of the configurations.

After the measurement of the lens configuration is complete, the main control part 160 processes the lens LE based on the processing data. The main control part 160 drives the motor 745 to move the carriage 701 in the X axis direction so as to position the lens LE above the rough grinding stone 602*b* (or the rough grinding stone 602*a*), and thereafter drives the motor 750 to move the carriage 701 in the Y axis direction (vertically), thereby carrying out the rough processing. Subsequently, the carriage 701 is moved in the X axis direction so that the lens LE is moved to a flat part of the finish grinding stone 602*c*, and similarly the carriage 701 is moved in the Y axis direction to carry out the finish processing.

In case that the piercing is to be carried out, the piercing-chamfering-grooving mechanism part 800 is used after the finish processing.

Figure 8B:
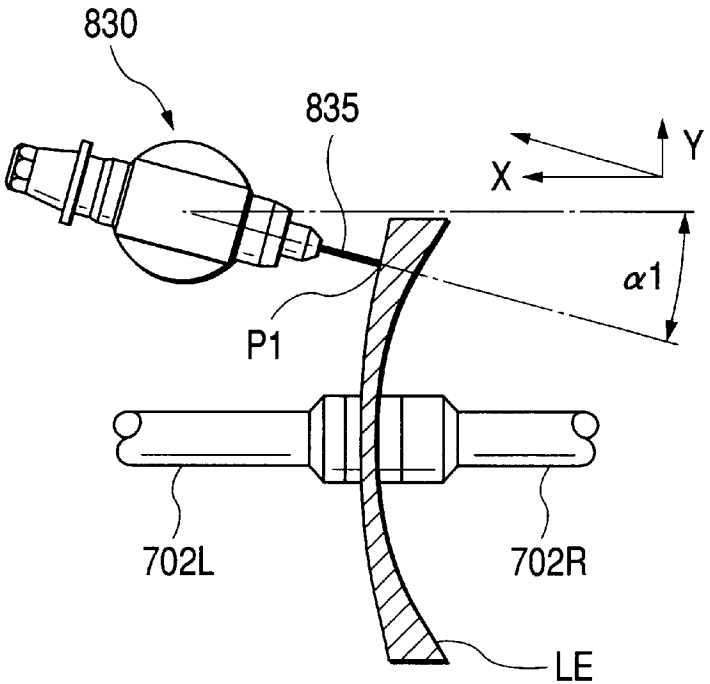
FIGS. 8A and 8B are views for explaining piercing.
Figure 8A:
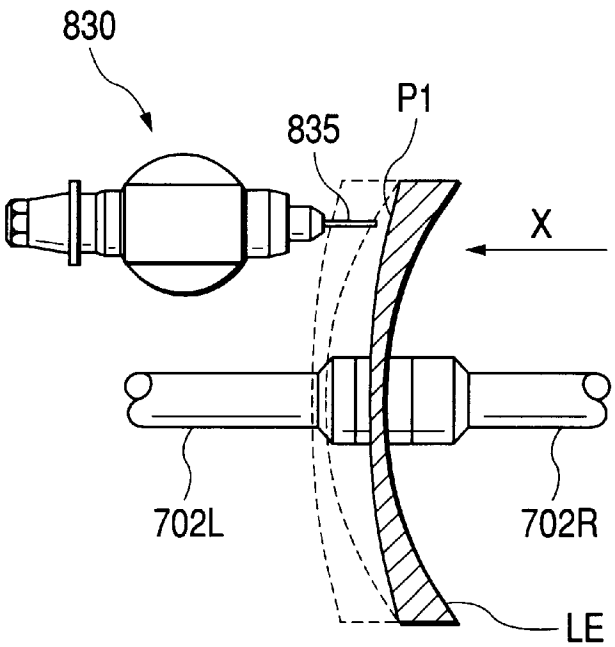

The piercing will be explained. FIG. 8A is an example in which the piercing is executed in a direction parallel to the shafts 702L and 702R (in the X axis direction). In this case, the main control part 160 drives the motor 816 to rotate the support base 810 so that the shaft 831 of the drill 835 is positioned in parallel to the shafts 702L and 702R. The leading end of the drill 835 is positioned to a hole position P1 of the lens LE by movement of the carriage 701 in the X axis direction by the motor 745, movement of the carriage 701 in the Y axis direction by the motor 750, movement of the drill 835 (the rotation part 830) in the Z axis direction by the motor 805 and rotation of the shafts 702L and 702R by the motor 720. Subsequently, the drill 835 (the shaft 831) is rotated by the motor 840, and the motor 745 is driven to move the carriage 701 in the X axis direction to thereby move the lens LE toward the drill 835. The piercing is carried out in this manner.

Figure 10:
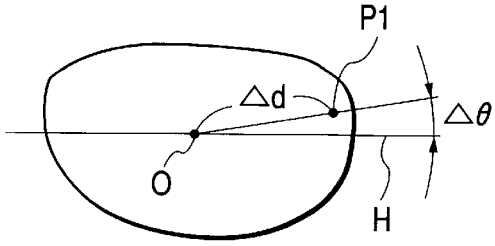
FIG. 10 is a view for explaining hole position data.

The data on the hole position P1 is in advance input by operating the switches on the switch panel 420, and stored in the memory 161. The data on the hole position P1 is, for example as shown in FIG. 10, measured as a polar coordinate ($\Delta\theta$, $\Delta d$) with respect to a geometrical center O of the target lens shape (or the optical center of the lens LE). A reference for $\Delta\theta$ is defined as a horizontal direction H under a condition in which the lens LE is mounted to the eyeglass frame. The positional data may be a rectangular coordinate system. The main control part 160 converts the data on the hole position P1 into the respectively directional data of the X, Y, and Z axes, and positions the leading end of the drill 835 at the hole position PI based on the obtained data.

Figure 9A:
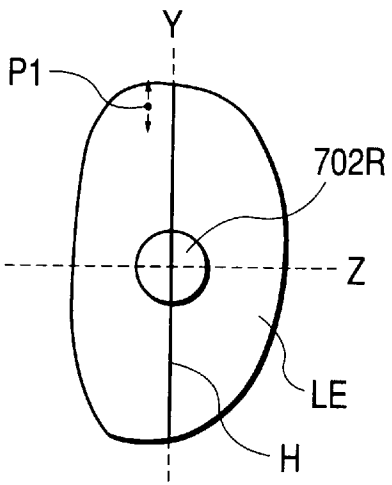
FIGS. 9A, 9B and 9C are views for explaining the piercing.

The piercing can be performed in an arbitrary direction in the lens LE in a manner as follows. In this case, the arranging angle of the lens LE is changed by rotating the shafts 702L and 702R in accordance with the hole direction. For example, FIG. 9A shows a case where the lens LE is rotated such that the horizontal direction H of the lens LE is coincident with the Y axis direction. Under this condition, if the shaft 831 of the drill 835 is, as shown in FIG. 8B, inclined by an angle al with respect to the X axis direction using the motor 816, it is possible to obtain (form) a hole inclined by the angle al in the same direction as the horizontal direction H of the lens LE.

Figure 9B:
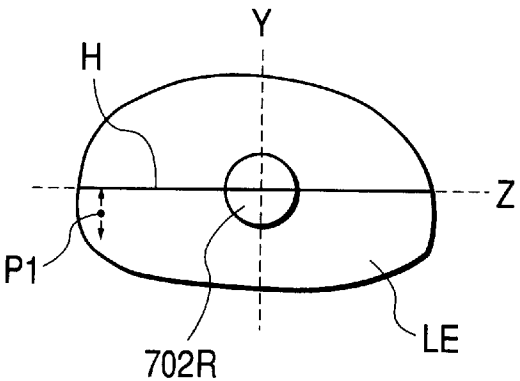

FIG. 9B shows a case where the lens LE is rotated such that the horizontal direction H of the lens LE is coincident with the Z axis direction. Under this condition, if the shaft 831 of the drill 835 is inclined by an angle $\alpha 1$ with respect to the X axis direction, it is possible to obtain (form) a hole inclined by the angle $\alpha 1$ in the direction perpendicular to the horizontal direction H of the lens LE.

Figure 9C:
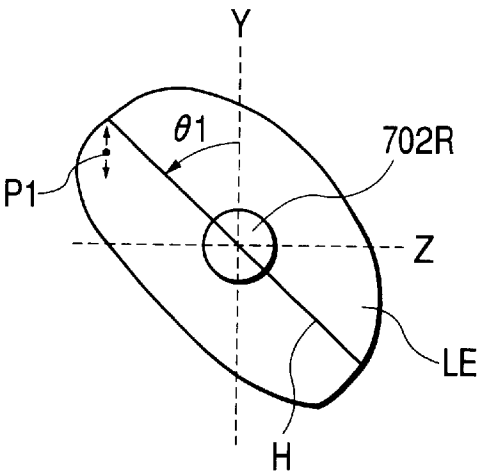

FIG. 9C shows a case where the lens LE shown in FIG. 9A is rotated counterclockwise by an angle $\theta 1$. Under this condition, if the shaft 831 of the drill 835 is inclined by an angle $\alpha 1$ with respect to the X axis direction, it is possible to obtain (form) a hole inclined by the angle $\alpha 1$ in the rotation angle $\theta 1$ direction of the lens LE. In addition, the case of FIG. 9B corresponds to a situation in which the lens LE shown in FIG. 9A is rotated counterclockwise by $\theta 1=90°$.

That is, the hole direction can be managed by the inclined angle $\alpha 1$ of the shaft 831 of the drill 835 and by the rotation angle $\theta 1$ of the lens LE. The data on the hole direction are also preliminarily input by operating the switches on the switch panel 420, and stored in the memory 161. In addition, as the piercing data (the hole position data and the hole direction data), it is possible to use designing data of a two point frame, which may be obtained and input to the apparatus using a communications system such as a personal computer.

When piercing, the main control part 160 controls, on the basis of the hole direction data, the rotation angle $\theta 1$ of the lens LE (the shafts 702L and 702R) by the motor 720 and the inclined angle $\alpha 1$ of the shaft 831 of the drill 835 by the motor 816. The main control part 160 positions the leading end of the drill 835 at the hole position P1 of the lens LE on the basis of the hole position P1 data by the movement of the carriage 701 in the X axis direction by the motor 745, the movement of the carriage 701 in the Y axis direction by the motor 750, and the movement of the drill 835 (the rotation part 830) in the Z axis direction by the motor 805. Subsequently, the drill 835 (the shaft 831) is rotated by the motor 840, and the carriage 701 is moved in the X axis direction by the motor 745 and in the Y axis direction by the motor 750, so that the piercing is carried out. That is, the piercing is carried out by moving the lens LE in the rotation axis direction of the shaft 831 (the direction of the inclination angle α1) by the movement of the carriage 701 in the X axis and Y axis directions.

Since the present embodiment employs a mechanism in which the carriage 701 is linearly moved in the Y axis direction, the control of the piercing is easier than a mechanism in which the carriage 701 is swingably moved so that the shafts 702L and 702R are always in parallel to the shaft 601*a* (see, for example, Japanese patent laid open 5-212661, and Re. 35,898 (U.S. Pat. No. 5,347,762)). Of course, the present invention can be applied to the mechanism in which the carriage 701 is swingably moved.

Figure 11A:
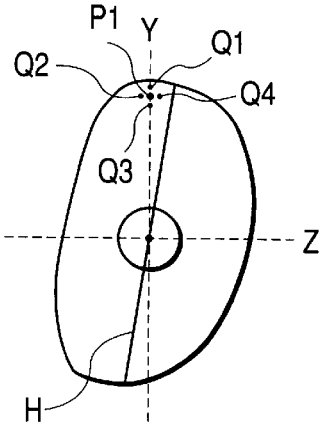
FIGS. 11A and 11B are views for explaining the piercing in a normal direction in a lens front surface.
Figure 11B:
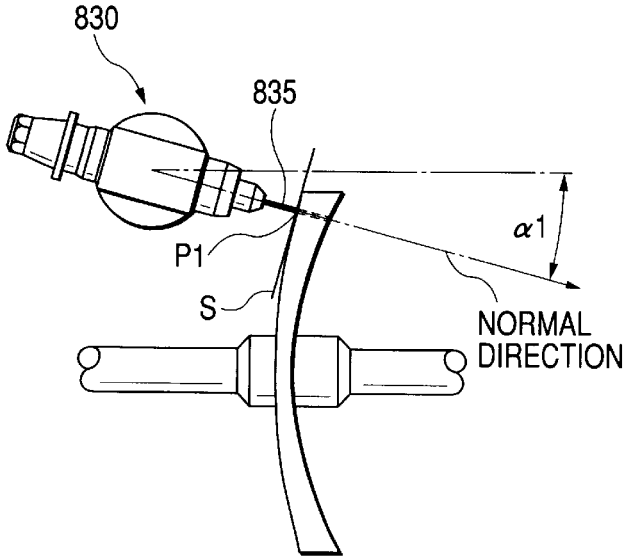

Next, the piercing in the normal direction of the Lens front surface will be explained. In this case, as shown in FIG. 11, point Q1, Q2, Q3, and Q4 (at least three points) around the hole position P1 are measured by the lens configuration measurement part 520. From the measured results, a tangential plane S at the hole position P1 is approximately derived, and the normal direction is calculated as a vertical direction of the tangential plane S at the hole position P1 (see FIG. 11B). The data on the calculated normal direction are stored in the memory 161.

If the lens front surface configuration is preliminarily known, the data are input via a communications system, and the normal direction can be calculated based on the input data and the hole position P1 data. When piercing, the inclined angle α1 of the shaft 831 of the drill 835 and the rotation angle θ1 of the lens LE are controlled on the basis of the normal direction data. The leading end of the drill 835 is positioned at the hole position P1 of the lens LE, and then the lens LE is moved by the movement of the carriage 701 in the X axis and Y axis directions, whereby the piercing is carried out at the hole position P1 of the lens LE in the normal direction.

Using the piercing method as mentioned above, if the drill 835 is changed to an end mill, it is possible to apply a milling process, a process of forming an elongated hole or the like to the lens LE. For example, in the case of forming the elongated hole, the carriage 701 is moved in the X axis and Y axis directions or the rotation part 830 of the end mill is moved in the Z axis direction, in conformity with an elongating axis direction of the elongated hole during processing the lens LE, thereby forming the elongated hole.

Figure 14:
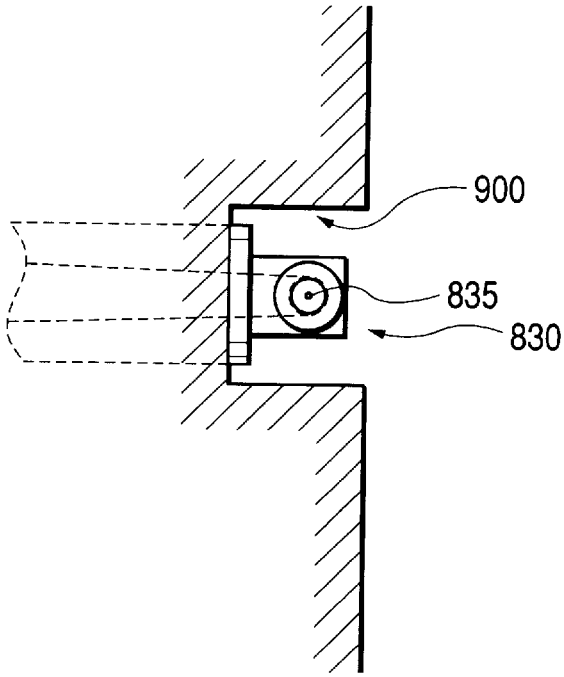
FIG. 14 is a view showing a state in which a rotation part for piercing, chamfering and grooving is housed.

During grinding the lens LE with the grinding stone group 602, since glass broken pieces are scattered in the processing chamber, the drill 835 (the rotation part 830) is desirably protected. To this end, as shown in FIG. 14, a recess like housing part 900 is provided in a wall of the processing chamber for storing the rotation part 300 moved in the Z axis direction to the retreat position.

Figure 12:
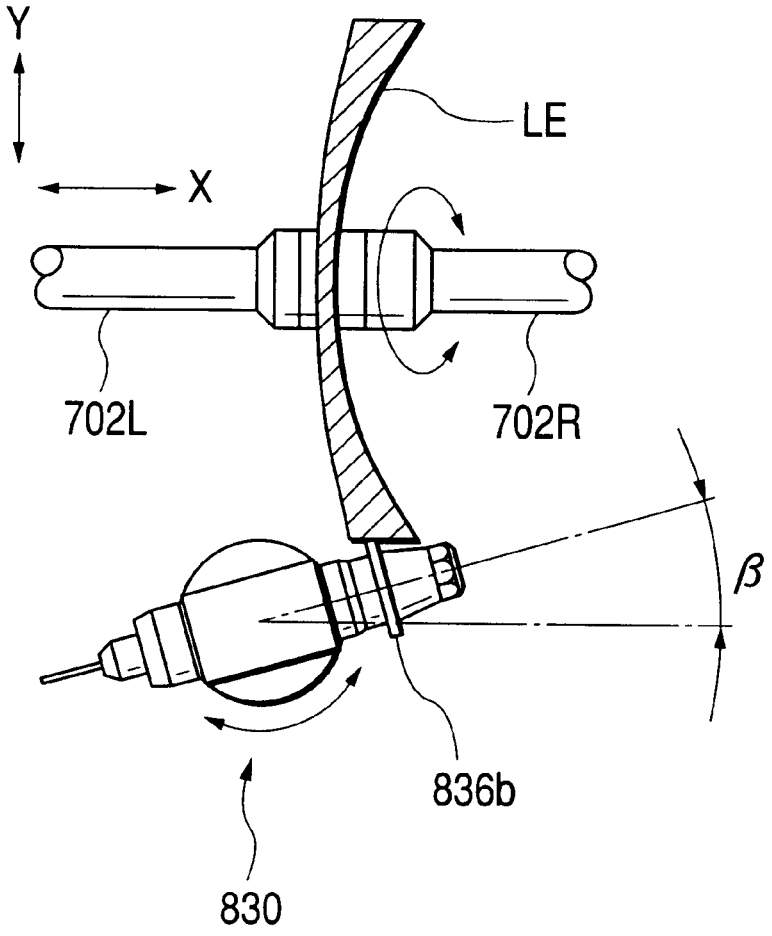
FIG. 12 is a view for explaining grooving.

Next, the grooving will be explained. The main control part 160 positions the lens LE above the grooving grinding stone 836*b* as shown in FIG. 12 by the movement the carriage 701 in the X axis direction by the motor 745, the movement of the carriage 701 in the Y axis direction by the motor 750, the movement of the grooving grinding stone 836*b* (the rotation part 830) in the Z axis direction by the motor 805, and the rotation of the grooving grinding stone 836*b* (the rotation part 830) by the motor 816.

The main control part 160 controls, based on grooving data, the movement of the carriage 701, the rotation of the lens LE, and the inclination angle β of the shaft 831 of the grooving grinding stone 836*b*.

The grooving data are in advance obtained by the main control part 160 from the radius vector data of the lens LE and the measured result of the lens configuration. The control of the movement of the carriage in the X axis direction and in the Y axis direction is executed on the basis of grooving locus data. The grooving locus data is indicative of a locus of a groove formed in the edge surface of the lens LE, and is expressed by radius vector data (angle and length of the radius vector) obtained from the target lens shape by taking the groove depth into consideration, and positional data in the X axis direction. Since the lens edge thickness is obtained from the measurement data of the lens configuration, the positional data in the X axis direction can be determined based on the edge thickness in the same manner as the method of determining the bevel position. For example, various methods can be used, which include, but not limited to, a method of setting a groove position at a position obtained by dividing the lens edge thickness at a certain ratio, and a method of setting the groove position at a position shifted from the edge position on the lens front surface toward the lens rear surface by a constant amount so that the groove extends along the lens front surface curve.

Figure 13:
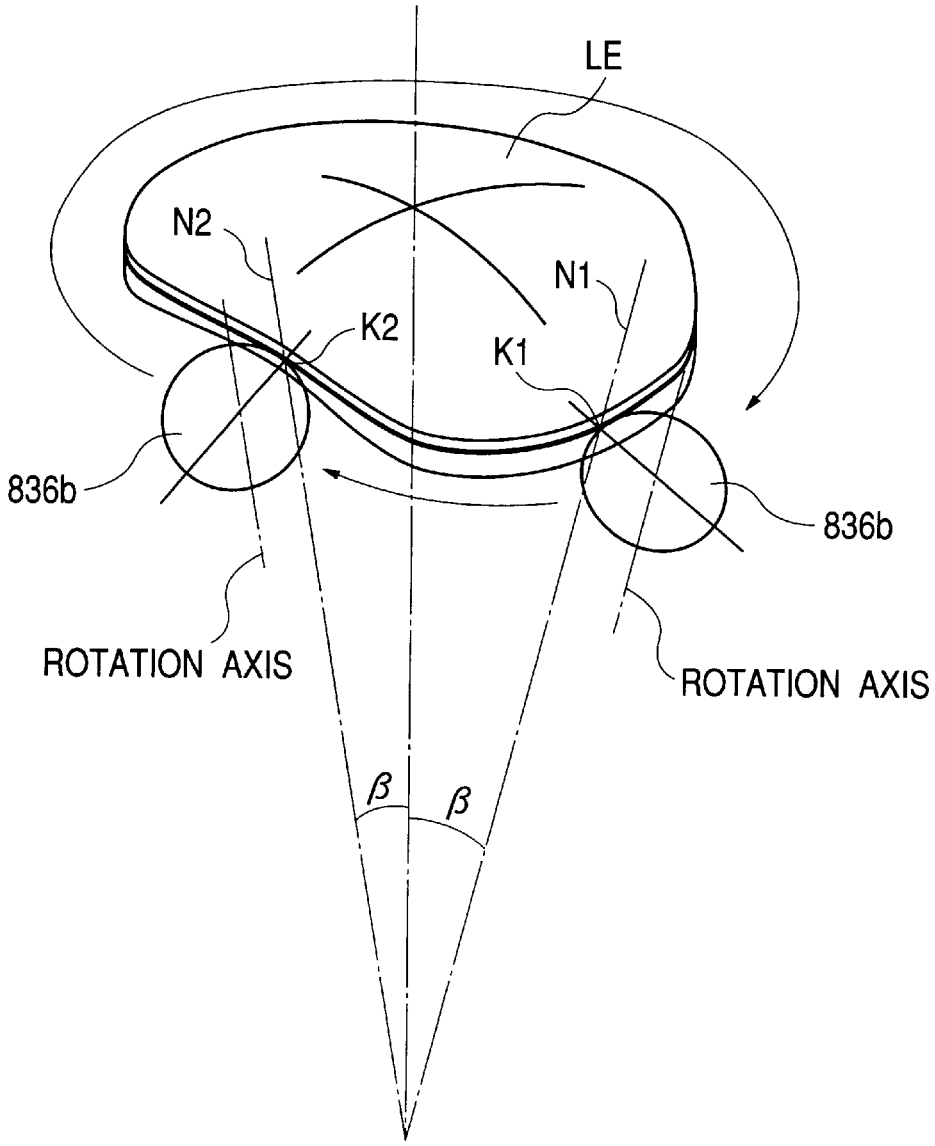
FIG. 13 is a view for explaining that a spherical surface supposed from a curve of a grooving locus is obtained, and a rotation shaft of a grooving grinding stone is inclined in a normal direction at each processing point.

Herein, if the grooving is performed on the entire periphery of the lens LE-with the inclination angle β of the shaft 831 of the grooving grinding stone 836*b* being fixed, the groove width will be partially widened. Therefore, a countermeasure is prepared as follows. As shown in FIG. 13, a spherical surface supposed from a curve of the grooving locus is obtained, and a normal direction at each processing point of the grooving locus is obtained. N1 and N2 of FIG. 13 respectively show normal directions of processing points K1 and K2. By inclining the shaft 831 of the grooving grinding stone 836*b* in the normal direction, the data on the inclination angle β of the shaft 831 of the grooving grinding stone 836*b* can be obtained correspondingly to the radius vector angle of each processing point. Under a condition where an outer circumference of the grinding stone contacts the spherical surface supposed from the curve of the grooving locus entirely, each processing point is obtained by effecting a grinding stone diameter correction (see, for example, Japanese patent laid open 5-212661 and Re. 35,898 (U.S. Pat. No. 5,347,762)) three-dimensionally. This makes it possible to suppress the widening of the groove width.

The movement position of the grooving grinding stone 836*b* in the Z axis direction in FIG. 13 represents a case in which the shaft 831 of the grooving grinding store 836*b* is positioned on the X and Y axes plane where the shaft 702L and 702R are moved on the assumption that a center of the spherical surface supposed from the curve of the grooving locus is positioned on the shafts 702L and 702R. In a case in which the center of the spherical surface supposed from the curve of the grooving locus is offset from the shafts 702L and 702R, the motor 805 is driven under such a control that the movement position of the grooving grinding stone 836*b* in the Z axis direction is changed in response to the offset amount. This makes it possible to suppress the widening of the groove width Further, if the outer diameter of the grooving grinding stone is too large, the groove is likely to be widened in comparison to the width of the grooving grinding stone. In the present apparatus, the outer diameter of the grooving grinding stone 836*b* is around 15 mm, so that it is possible to prevent the groove from being widened in comparison to the width of the grooving grinding stone.

The grooving is carried out by changing the inclination angle β of the grooving grinding stone 836*b* at each processing point, while pressure-contacting the rotated lens LE with the rotated grooving grinding stone 836*b* by the linear movement of the carriage 701 in the X axis and Y axis directions. Similarly to the piercing, the mechanism in which the carriage 701 is swingably moved may be employed.

Figure 15:
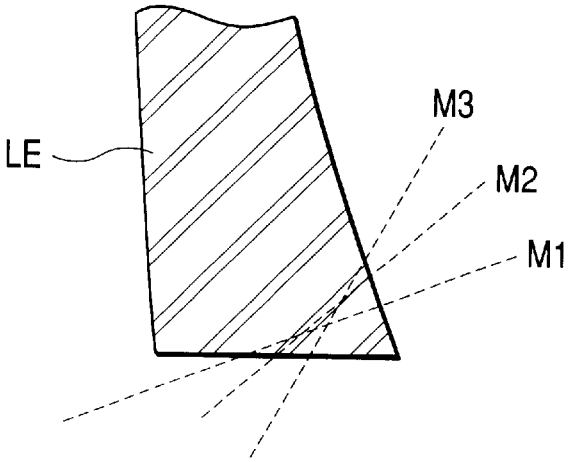
FIG. 15 is a view for explaining a plural-staged chamfering by changing a chamfering angle in plural stages.

In a case where the chamfering mode is set, the main control part 160 moves and controls, after the completion of the piercing or the grooving, the carriage 701 and the piercing-chamfering-grooving mechanism part 800 on the basis of the chamfering data to execute the chamfering. During the chamfering, the chamfering grinding stone 836*a* of the grinding stone 836 is contacted with the corner of the edge of the lens LE to grind the edge corner. Also in this chamfering, the inclination angle β of the shaft 831 of the chamfering grinding stone 836*a* can be changed, and therefore it is possible to set a chamfering angle to be processed to the edge corner of the lens LE in an arbitrarily manner. Further, as shown in FIG. 15, the processing surface of the chamfering grinding stone 836*a* can be inclined at angles M1, M2, and M3 to change the chamfering angle in plural steps, thereby forming a chamfered surface made up of plural staged slope parts at the edge corner of the same radius vector angle.

During the chamfering, the chamfering grinding stone 836*a* is arranged at the same processing position as the grooving, and the inclination angle β of the shaft 831 is controlled in accordance with the set chamfering angle. The position of the edge corner of the lens LE can be obtained from the measurement of the lens configuration based on the target lens shape. The respective processing data are calculated correspondingly to the angles M1, M2 and M3 at which the processing surface of the chamfering grinding stone 836*a* is inclined, and in accordance with the processing data, the movement of the carriage 701 in the X axis direction or the Y axis direction is controlled. In a case where the plural staged slope parts are to be formed, the lens LE is rotated at each of the set angles. Using the formation of such plural staged slope parts, the lens edge corners can be finished to provide a design.

The embodiment as mentioned above have been made to the apparatus of a type in which the carriage 701 having the shafts 702L and 702R for clamping and rotating the lens LE is moved in the X axis and Y axis directions, but the present invention can be applied to an apparatus of such a type as disclosed in Patent Laid Open 9-253999 and U.S. Pat. No. 5,716,256, in which the grinding stone side for processing the periphery is moved in the X axis and Y axis directions. In such an apparatus, since the lens LE is not moved in the X axis and Y axis directions, the apparatus is arranged to have a moving mechanism for relatively moving the piercing-chamfering-grooving mechanism part 800 side in the X axis and Y axis directions.

Further, it is not essential to perform the movement of the rotation part 830 in the Z axis direction as the linear movement.

That is, similarly to the carriage 701, the movement of the rotation part 830 may be a swingable movement (Note that the linear movement is preferably in view of ease of control). Moreover, if the shafts 702L and 702R, the shaft 601*a* and the shaft 831 are disposed in parallel to the same plane, the moving mechanism for the rotation part 830 in the Z axis direction can be dispensed with.

As mentioned above, according to the invention, it is possible to easily carry out the good piercing, irrespective of a worker's skillfulness. As the hole direction can be determined freely, it is possible to take into consideration a counteraction of the lens when making the frame.

What is claimed is:

1. An eyeglass lens processing apparatus for processing a periphery of an eyeglass lens, comprising:

a lens rotation shaft which holds and rotates the lens, the shaft being rotatable about a first axis;

a piercing tool which pierces a hole in the lens;

a holder which rotatably holds the piercing tool; and inclination means for relatively inclining the holder with respect to the lens rotation shaft to change inclination of a rotation axis of the piercing tool with respect to the first axis.

2. The apparatus of claim 1, further comprising:

control means for controlling rotation of the lens rotation shaft and inclination by the inclination means, based on piercing data including hole direction data.

3. The apparatus of claim 2, further comprising:

first moving means for relatively moving the lens rotation shaft linearly in a direction of the first axis with respect to the piercing tool; and second moving means for relatively moving the lens rotation shaft linearly in a direction of a second axis perpendicular to the first axis or swingably to direct the first axis to the same direction, with respect to the piercing tool;

wherein the control means controls movement by each of the first and second moving means, based on the piercing data including hole position data.

4. The apparatus of claim 3, wherein the inclination means includes rotation means for rotating the holder about a third axis perpendicular to the first axis, the rotation axis of the piercing tool being perpendicular to the third axis.

5. The apparatus of claim 3, further comprising:

third moving means for moving the piercing tool between a piercing position and a retreat position, wherein the control means controls movement by the third moving means, based on the piercing data.

6. The apparatus of claim 5, wherein the third moving means moves the piercing tool linearly in a direction of the third axis.

7. The apparatus of claim 5, further comprising:

protection means for protecting the piercing tool moved to the retreat position.

8. The apparatus of claim 3, further comprising:

a grinding tool rotation shaft which holds and rotates a grinding tool for grinding the periphery of the lens, the grinding tool rotation shaft being rotatable about a fourth axis parallel to the first axis, wherein the first moving means relatively moves the lens rotation shaft linearly with respect to the grinding tool, wherein the second moving means relatively moves the lens rotation shaft linearly or swingably with respect to the grinding tool, wherein the control means control rotation of the lens rotation shaft and movement by the second moving means, based on periphery grinding data.

9. The apparatus of claim 2, further comprising:

lens configuration measurement means for measuring a front surface configuration of the lens; and calculation means for obtaining a normal direction at a hole position in the lens front surface, based on the obtained configuration, wherein the hole direction data includes data on the obtained normal direction.

10. The apparatus of claim 1, wherein the holder holds at least one of a grooving grinding stone for forming a groove in an edge surface of the lens and a chamfering grinding stone for chamfering an edge corner of the lens to be rotatable coaxially with respect to the piercing tool.

11. The apparatus of claim 1, wherein the inclination means includes rotation means for rotating the holder about an axis perpendicular to the rotation axis of the piercing tool.

12. The apparatus of claim 1, further comprising:

moving means for moving the piercing tool between a piercing position and a retreat position.

13. An eyeglass lens processing apparatus for processing a periphery of an eyeglass lens, comprising:

a lens rotation shaft which holds and rotates the lens, the shaft being rotatable about a first axis;

a piercing tool which pierces a hole in the lens; and a holder which rotatably holds the piercing tool, wherein the holder holds at least one of a grooving grinding stone for forming a groove in an edge surface of the lens and a chamfering grinding stone for chamfering an edge corner of the lens to be rotatable coaxially with respect to the piercing tool.

* * * * *